United States Patent [19]

Ringrose

[11] Patent Number: 4,615,344

[45] Date of Patent: Oct. 7, 1986

[54] CIGARETTE WITH AUTOMATIC VENTILATION VALVE

[75] Inventor: Anthony Ringrose, Chenes-Bougeries, Switzerland

[73] Assignee: Battelle Memorial Institute, Carouge, Switzerland

[21] Appl. No.: 580,077

[22] Filed: Feb. 14, 1984

[30] Foreign Application Priority Data

Feb. 15, 1983 [CH] Switzerland ..... 823/83

[51] Int. Cl.[4] ..... A24D 3/04

[52] U.S. Cl. ..... 131/198.2; 131/206; 131/215.3

[58] Field of Search ..... 131/198 A, 198 R, 206, 131/215.3, 198.1, 198.2

[56] References Cited

U.S. PATENT DOCUMENTS

| | | | |
|---|---|---|---|
| 2,166,172 | 7/1939 | Modine | 131/198 A |
| 2,233,287 | 2/1941 | Modine | 131/198 A |
| 2,233,288 | 2/1941 | Modine | 131/198 A |
| 2,264,626 | 12/1941 | Dunwoodie | 131/198 A |
| 3,441,028 | 4/1969 | Wall | 131/198 A |

*Primary Examiner*—V. Millin

*Attorney, Agent, or Firm*—Karl F. Ross; Herbert Dubno

[57] ABSTRACT

A cigarette is provided with an automatic valve responsive to the moisture content of the smoke for controlling induction of air into the smoke thereby compensating for the increase of nicotine concentration as the cigarette smokes down. The valve utilizes a bilamellar strip having sides of different hydrophilic character and distorting as a result of elongation of the more hydrophilic side.

14 Claims, 8 Drawing Figures

CIGARETTE WITH AUTOMATIC VENTILATION VALVE

FIELD OF THE INVENTION

My present invention relates to a cigarette and, more particularly, to a cigarette which is provided in its wall at the aspiration opening through which smoke is drawn into the mouth of a smoker, with at least one orifice permitting the induction of air to dilute the smoke.

BACKGROUND OF THE INVENTION

Cigarettes having ventilating openings in mouthpieces or filters at the aspiration end of the cigarette and in the wall or opening thereof are commonly available and are intended to permit the smoker, as he inhales, to induce ambient air into the mouthpiece or filter and into the mouth of the smoker to dilute the smoke. This is intended to create the effect of a light cigarette by decreasing the density of the smoke reaching the user.

In practice, however, it is found that the level of nicotine in cigarettes increases substantially from the beginning of smoking toward the end of the cigarette. When air is drawn at a constant rate into admixture with smoke, therefore, the rest of the cigarette varies over the direction of smoking, because the composition of the smoke changes, i.e. the nicotine is more greatly diluted at the beginning of smoking and is subjected to lesser dilution toward the end of the cigarette. A cigarette which can be considered a light smoking cigarette at the start may be found to be a strong cigarette at the end.

It has been proposed, e.g. in U.S. Pat. No. 4,327,748, to provide a cigarette holder having a manually controllable valve which is intended to regulate the amount of air induced into the inhaled smoke in accordance with the wishes of the smoker and hence the personal tastes. This, however, does not solve the problem of increasing nicotine concentration unless the user is willing to continuously vary the valve position as the particular cigarette is smoked. This, of course, is impractical and hence generally a single setting is selected for a particular type of cigarette to avoid adjustment over the duration of smoking, i.e. for the extent to which cigarettes are smoked for each smoked cigarette.

In U.S. Pat. No. 3,441,028, moreover, a cigarette holder has been described in which the smoke passage is provided with a constriction having a metallic valve responsive to the temperature and adapted to control the introduction of air into the smoke. A filter in this cigarette holder is disposed downstream of the valve to trap components of the smoke which condense by cooling as a consequence of the admission of air.

This system has the disadvantage that it is difficult to provide a bimetallic control which is sufficiently sensitive to react to the very small temperature differences which are found in the cigarette smoke. Indeed, the temperature of the smoke varies very little during the consumption of a cigarette so that the change in temperature cannot be considered truly a parameter which parallels the concentration of nicotine in the smoke.

OBJECTS OF THE INVENTION

It is, therefore, the principal object of the present invention to prvide a cigarette which responds to the change in nicotine concentration in the smoke, during the smoking or consumption thereof and which is able to automatically vary the mixture of ambient air with the smoke in response to this variation in concentration between the beginning and end of the cigarette.

Still another object of this invention, more generally, is to provide a light cigarette which has substantially the same taste and smoke dilution effect during the entire smoking duration, i.e. from the beginning of the cigarette to the end thereof.

Yet another object of my invention is to provide an improved method of overcoming the disadvantages of the systems described in these earlier patents and, indeed, to improve more generally the ventilation of the smoke of a cigarette.

SUMMARY OF THE INVENTION

These objects and others which will become apparent hereinafter are attained, in accordance with the invention, in a cigarette provided with at least one orifice close to the aspiration end of the cigarette through which ambient air can be admitted into admixture with inhaled smoke and a valve responsive to a parameter constituting a measure of the progress of smoking and hence the nicotine concentration to selectively control the induction of air through this orifice and thereby increase the air induction with the progress of smoking so that the smoke is progressively diluted with an increasing volume of air to compensate partially for the increase of concentration of nicotine and thereby provide a cigarette with a substantially constant taste.

According to an essential feature of the invention, the automatically responsive valve comprises a foil or strip valve member whose two faces have hydrophilic properties different from one another and which thus are affected differently by the presence of water vapor contained in the smoke so that these faces are subject to different elongations in the response to the moisture and deform the valve member, thereby increasing the ventilation cross section with the progress of smoking.

According to a feature of the invention, the strip is a bilamellar member consisting of a layer of paper and a layer of plastic or synthetic resin material bonded together by an adhesive.

According to another feature of the invention, an annular part of the envelope or wrapping of the cigarette disposed downstream (in the direction of travel of the smoke) from the portion provided with the tobacco, is pierced with a series of orifices, the strip being applied against the internal face of this annular part and having its more hydrophilic face turned toward the internal face of the envelope or wrapping. To permit contact of the more hydrophilic face with the moisture contained in the cigarette smoke or condensed therefrom, the internal part of the strip is formed with perforations to allow the external part to be subjected to the moisture.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
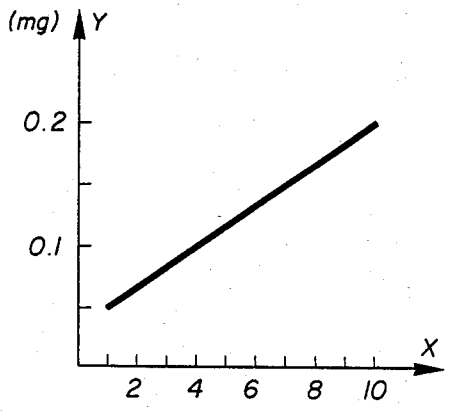
FIGS. 1 and 2 are graphs facilitating an explanation of the invention.

FIG. 1 is a diagram (graph) in which the variation in nicotine concentration in cigarette smoke is plotted in milligrams along the ordinate y while the number of puffs drawn on the cigarette is plotted along the abscissa x. From this diagram it should be immediately apparent that the concentration of nicotine in the cigarette smoke is about four times greater at the beginning of smoking than at the end of the cigarette.

Figure 2:
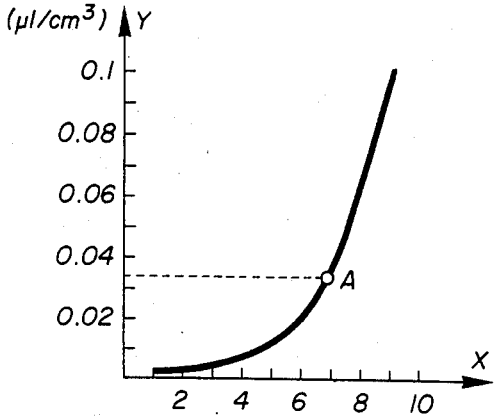

In FIG. 2, we have represented the variation of the quantity of water in the cigarette smoke with the number of puffs. Along the ordinate y in this graph, the quantity of water is expressed in microliters per cubic meter while the number of puffs is expressed along the abscissa x. From this graph it should be evident that the quantity of water is about ten times greater at the end of the cigarette than at the beginning in the smoke.

By making the valve of the invention responsive to the moisture content of the smoke, therefore, I am able to control the valve with a high degree of sensitivity to regulate the induction of air with the progress of smoking and hence with the nicotine concentration, without resorting to temperature parameters or the like which show little change in the course of smoking.

I have found that the best approach to respond to moisture content is to utilize the bilamellar principle well-known in mechanics for bimetallic thermally responsive elements where the bimetallic strip consists of two metals having different thermal coefficients of expansion.

In the present case, however, a bilamellar strip is provided which is not sensitive to heat but rather is sensitive to humidity and is constituted by a foil or strip, one of the faces of which is substantially more hydrophilic than the opposite face indeed to the point that one of the faces can be considered substantially hydrophilic while the other is substantially hydrophobic.

This foil can be fabricated by adhesively bonding a paper foil to a synthetic resin, e.g. with an adhesive layer by a thermobonding process. The synthetic resin has lesser hydrophilic activity than the paper and indeed the paper can be provided with a wetting agent to render it more hydrophilic.

Alternatively, a strip of paper can be used which is covered at one side with a water-repellent foil, i.e. a hydrophobic substance, while its opposite side is uncovered or provided with a wetting agent.

Tests have shown that the paper foil can be comparatively thin and strong while nevertheless having substantially hydrophilic properties at one surface and indeed that even cigarette papers can be utilized for that purpose.

In this case, the cigarette paper can be bonded by a self-sticking adhesive to a plastic foil, e.g. a pressure-sensitive tape such as the pressure-sensitive tape marketed by the Minnesota Mining and Manufacturing Co. (3M Company) under the name SCOTCH tape.

When this face has its hydrophilic side exposed to the humidity of air exhaled from the lungs and corresponding substantially to point A of the curve of FIG. 2 with a strip of a length of 2 cm, retained at one end, one can observe a deflection of the free end of about 2 mm.

The effectiveness of the strip as a valve member was also demonstrated with bilamellar strips in a tube at one end of which a cigarette was mounted and at the opposite side of which smoke was aspirated from the cigarette. These tests also indicate that there was a significant deflection by the humidity in the smoke which resulted in an elongation of the hydrophilic face and thus a deformation of the bilamellar element rendering the hydrophilic face convex and the other face concave.

Different types of paper were also tested and it was found that highly absorbent papers, such as papers used as facial tissues, do not function as well as the cigarette paper apparently as a consequence of the structural differences. Papers which are substantially thicker than cigarette papers also show poorer results. Because only one face of the bilamellar element is hydrophilic, the invention also provides means for enabling that face to come into contact with the smoke and hence inducing opening of the valve by the deformation of the strip.

Figure 3:
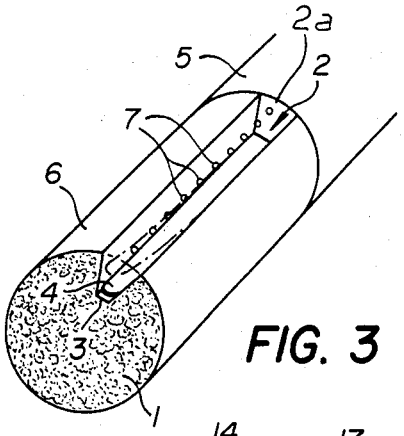
FIG. 3 is a diagrammatic perspective view of the filter end of a cigarette according to the invention.

FIG. 3 shows a cigarette filter 1 provided with an automatic valve controlling the induction of air as a function of the humidity resulting from smoking of the cigarette. The cigarette filter 1 is provided with a longitudinal channel 2 whose cross section is generally trapezoidal or corresponds substantially to a truncated sector of a circle. The truncate face 3 of the sector is porous while the remaining faces are impermeable. The porous face 3 is covered by a bilamellar strip 4 of the type described above with its hydrophilic face turned toward the interior of the filter 1 so that it enables it to come into contact with smoke aspirated from the tobacco portion of the cigarette through the filter. The end of the bilamellar element 4 adjacent the tobacco containing part 5 of the cigarette is fixed to the porous foil while its other end 3 is free. The end wall 2*a* of the channel is also impermeable. The filter 1 is wrapped by an impermeable envelope 3 of treated cigarette paper or the like which is provided with a number of orifices 7 along the channel opening into the atmosphere.

During smoking of the cigarette with each puff there is an increase in the moisture content of the smoke and hence a progressive increase in the concentration of moisture contacting the hydrophilic surface of the bilamellar strip. The latter deforms into the position shown in dot-dash lines in FIG. 3, i.e. toward the broad side of the channel, increasing the flow cross section around this strip to ventilating air drawn through the orifices 7 into the filter and thus into the smoke. The bilamellar strip thus progressively allows increased quantities of air with smoking to maximum with the cigarette smoke and compensates at least in part for the increased concentration of nicotine. In the modification of this arrangement shown in FIG. 4, the filter 8 has two elongated recesses 9 defined between the filter 8 and the surrounding cylindrical envelope or sleeve 10. The sleeve 10 is formed with orifices 11 along each of the recesses and respective bilamellar elements 12 are mounted in the recesses and affixed to the sleeve at least at one end with their hydrophilic faces turned toward the interior.

Figure 4:
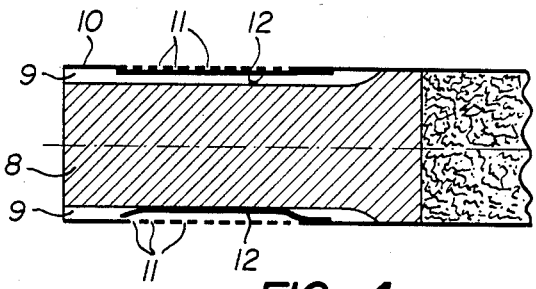
FIGS. 4 and 5 are axial sections of the filter ends of respective cigarettes illustrating embodiments of the invention.

This arrangement, of course, functions similarly to that which has previously been described in order that the bilamellar element 12 resumes the position shown at the upper part of FIG. 4 initially but moves progressively away from the orifices 11 as smoking proceeds, e.g. to the position shown at the bottom of FIG. 4, thereby progressively admitting greater and greater quantities of air as smoking proceeds.

Figure 5:
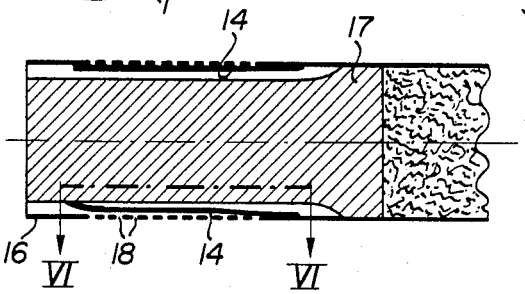
Figure 6:
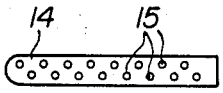
FIG. 6 is a view of the valve strip of FIG. 5 as taken in the direction of arrows VI—VI in FIG. 5.

In the embodiment of FIG. 5, a humidity-controlled valve responsive to the smoke is also provided but here the hydrophilic part of the bilamellar strip 14 is turned away from the cigarette smoke but the cigarette smoke is permitted to contact the hydrophilic part through holes 15, a multiplicity of which can be formed in the hydrophobic part of the bilamellar element as illustrated in FIG. 6, which is a plan view taken in the direction of arrows VI—VI of FIG. 5 and shows the hydrophobic surface of the strip 14 formed with the multiplicity of holes 15. Upon absorption of moisture, the external part of the strip elongates and swings the element 14 away from the envelope or sleeve 16 of the filter 17 to block the orifices 18 progressively and allow additional quantities of air to mix with the smoke as represented in the lower portion of FIG. 5.

Figure 7:
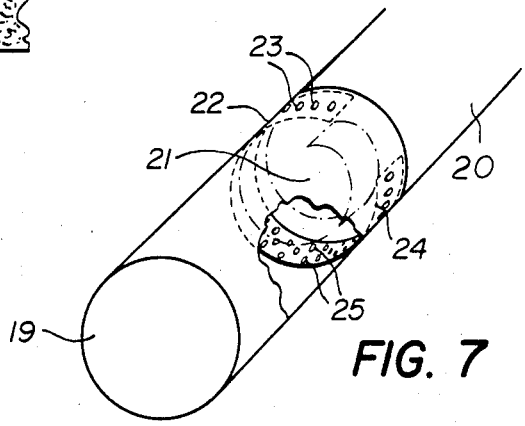
FIG. 7 is a perspective view, partly broken away and not showing a filter which may be present, of the filter end of a cigarette representing another embodiment of the invention.

The embodiment of FIG. 7 provides the valve between the body of filter 19 and the tobacco 20 of the cigarette. Here a compartment 21 is provided between the filter and the tobacco and is delimited externally by a cylindrical envelope or sleeve 22 provided with a series of orifices 23. The bilamellar strip 24 extends along this series of orifices and is applied between at least one part of the internal face of the envelope, being fixed thereto at one of its ends. The hydrophilic face of the bilamellar strip 24 is turned away from the interior, i.e. toward the inner wall of the envelope while the internal face of the strip is provided with perforations 25 to permit the internal part to receive moisture from the smoke. In the presence of moisture the bilamellar element 24 curls progressively inwardly and hence unblocks the orifices 23 to permit ambient air to mix in increasing quantities with the smoke as smoking proceeds.

Figure 8:
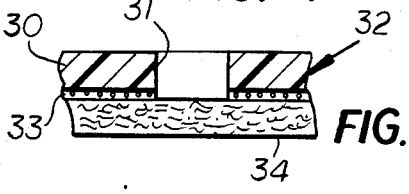
FIG. 8 is a cross section much greatly enlarged in scale through a valve strip according to the invention.

As can be seen in FIG. 8 the hydrophilic part may be formed by a synthetic resin layer 30 which can have holes 31 similar to those described at 15 and 25 and which can form a self-sticking pressure-sensitive tape 32 with an adhesive bonding layer 33. This tape can be applied to a paper foil 34 forming the hydrophobic part.

It is apparent that the automatic valve mechanism of the invention is not only entremely simple and reliable but is also of low cost requiring a minimum modification of the cigarette or filter and is fully competitive with present fabrication techniques. Naturally, the valve can also be applied to cigarettes without filters, simply by leaving pockets in the tobacco at the aspiration end of the cigarette and providing the valves in such pockets, or by providing the valves on sleeves or mouthpieces connected with the tobacco portion of the cigarette and free from filter bodies.

Because the air is mixed with the smoke in increasing quantities as smoking proceeds, a light cigarette does not become stronger with time and the taste remains substantially constant.

Obviously, although I have shown that all of the holes are closed initially, various ventilation orifices can be provided to ensure the desired degree of lightness of air mixing even at the inception of smoking.

I claim:

1. A cigarette comprising a tobacco containing portion subjected to progressive combustion with flow of smoke through an aspirating end and provided at said aspirating end with a valve controlling the degree of mixing of air with the smoke, said valve comprising at least one bilamellar strip having opposite faces of different hydrophilic character and deformable in response to the water vapor content of the smoke to regulate air admission thereto.

2. The cigarette defined in claim 1 wherein said bilamellar strip comprises a strip having a synthetic resin layer bonded to a paper layer, said paper layer being relatively hydrophilic, said synthetic resin layer being relatively hydrophobic.

3. The cigarette defined in claim 2 wherein said layers are bonded together by an adhesive.

4. The cigarette defined in claim 3 wherein said adhesive is a pressure-sensitive adhesive.

5. The cigarette defined in claim 4 wherein said synthetic resin layer and said adhesive form a pressure-sensitive strip.

6. The cigarette defined in claim 5 wherein said paper layer is formed by cigarette paper.

7. The cigarette defined in claim 1 wherein said end of said cigarette is provided with a filter, said valve being mounted in said filter.

8. The cigarette defined in claim 7 wherein said filter has a filter body formed with a longitudinal channel having a cross section of a truncated circular sector and defined between a permeable bottom wall and impermeable flanks, said strip being fixed at one end to said bottom wall and overlying same while having a hydrophilic side turned inwardly toward said body, said body being surrounded by a cylindrical sleeve having orifices opening into said channel.

9. The cigarette defined in claim 1 wherein said end is formed with a filter having a filter body provided with a recess, a cylindrical sleeve surrounding said body and provided with orifices opening into said recess, said strip being disposed between said body and said sleeve controlling air flow between said orifices and said body.

10. The cigarette defined in claim 9 wherein one end of said strip is fixed to said sleeve.

11. The cigarette defined in claim 9 wherein one end of said strip is affixed to said body.

12. The cigarette defined in claim 9 wherein said strip has a hydrophilic side turned away from said body and a hydrophobic side turned toward said body and provided with perforations enabling smoke to reach said hydrophilic side.

13. The cigarette defined in claim 1, further comprising a compartment at said end defined within a cylindrical sleeve provided with a series of orifices, said strip being received in said compartment and having a hydrophilic face turned toward the inner face of said sleeve, said orifices lying along a circumference of said sleeve.

14. The cigarette defined in claim 13 wherein said strip is formed on a hydrophobic side thereof with a multiplicity of holes enabling smoke to reach the hydrophilic side of said strip.

* * * * *